US009976445B2

(12) United States Patent
Amirouch et al.

(10) Patent No.: US 9,976,445 B2
(45) Date of Patent: May 22, 2018

(54) SYSTEM AND METHOD FOR REGULATING PRESSURE FOR A TURBOMACHINE

(71) Applicant: ALSTOM Technology Ltd, Baden (CH)

(72) Inventors: Nizar Amirouch, Evreux (FR); Victor Da-Cruz, Villeneuve le roi (FR); Jean-Marc Lop, Drancy (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 168 days.

(21) Appl. No.: 15/138,553

(22) Filed: Apr. 26, 2016

(65) Prior Publication Data

US 2016/0319700 A1 Nov. 3, 2016

(30) Foreign Application Priority Data

Apr. 29, 2015 (EP) ..... 15290115

(51) Int. Cl.
*F01D 25/18* (2006.01)
*F01D 25/20* (2006.01)
*F01M 1/16* (2006.01)

(52) U.S. Cl.
CPC ..... *F01D 25/20* (2013.01); *F01D 25/18* (2013.01); *F01M 1/16* (2013.01)

(58) Field of Classification Search
CPC ..... F01D 25/18; F01D 25/20; F01M 1/16
See application file for complete search history.

(56) References Cited

U.S. PATENT DOCUMENTS 2,298,646 A 10/1942 Ovens
6,053,195 A * 4/2000 Heer ..... F01M 1/16 137/115.21
2013/0081720 A1* 4/2013 Schmidt ..... F01M 1/16 137/565.11

FOREIGN PATENT DOCUMENTS

DE 102004049029 A1 4/2006
FR 2292858 A1 6/1976

* cited by examiner

*Primary Examiner* — Audrey K Bradley
(74) *Attorney, Agent, or Firm* — GE Global Patent Operation; Cynthia W. Flanigan

(57) ABSTRACT

A pressure regulating system which is an arrangement with a turbo machine for example a nuclear steam turbine. Main lubricant oil pump supply fluid for example lubricant oil to the nuclear steam turbine passes through a cooler and via filter through a main supply line. The pressure regulating system is connected to the main supply line through an actuating line. Based on requirement of the fluid excessive fluid can be diverted through the actuating line to the pressure regulating system and from there to oil tank. In oil tank an auxiliary lubricant oil pump is provided to supplement the supply of the lubricant oil to the nuclear steam turbine. An emergency lubricant oil pump has also been provided to supply the lubricant oil to the nuclear steam turbine in case when regular supply is not working.

2 Claims, 3 Drawing Sheets

SYSTEM AND METHOD FOR REGULATING PRESSURE FOR A TURBOMACHINE

CROSS-REFERENCE TO RELATED APPLICATIONS

This application claims priority to European Patent Application No. 15290115.3 filed Apr. 29, 2015, the contents of which are hereby incorporated in its entirety.

TECHNICAL FIELD

The present disclosure relates to a pressure regulating system for lubricating a turbo machine to and more particularly a system and method for regulating the pressure in a nuclear steam turbine.

BACKGROUND

Nuclear steam turbines mostly use centrifugal pumps to supply fluids especially lubricants oil. Apart from the centrifugal pumps, oil lubricant system of the nuclear steam turbines is fed in a normal operation by a pump which delivers a constant flow. During the operation of the nuclear steam turbine as per requirement several pumps are started or stopped or any other anomaly in pressure leading to sudden variation at lubricant oil manifold. These sudden lubricant oil pressure variation leads to the nuclear steam turbines trip. Also the current lubricant systems of the nuclear steam turbines are static and not respond to sudden requirement of the nuclear steam turbines. The tripping of the nuclear steam turbines is not good for the overall plant.

Consequently, there is need to provide a pressure regulating system which is simple in operation, easy in installation, less expensive in capital cost and more effective in tackling the sudden variations of the nuclear steam turbines and avoid the tripping of the nuclear steam turbines.

SUMMARY

The present disclosure describes a system and method for regulating the pressure in a turbo machine particularly nuclear steam turbine. This will be presented in the following simplified summary to provide a basic understanding of one or more aspects of the disclosure including all advantages. The sole purpose of this summary is to present some concepts of the disclosure, its aspects and advantages in a simplified form as a prelude to the more detailed description that is presented hereinafter.

An object of the present disclosure is to propose a system and method for regulating the pressure in a turbo machine particularly nuclear steam turbine which can be used in existing and in new unit installations to significantly reduce the emission of these pollutants.

The present invention offers a technical solution of controlling variation accurately of pressure at manifold of a pressure regulating system. The solution is to modify pressure regulating system by a dedicated arrangement of bypass which control variations of pressure at the manifold dynamically by responding adequately due to sudden variations of nuclear steam turbines by closing the pressure regulating system in less time than a regular time which leads to restoration of full supply of lubricant oil to the nuclear steam turbine in response of the sudden variations which can be tackled by supplying the adequate amount of the lubricant oil which is required for the working as well as avoiding the tripping of the nuclear steam turbine.

Various other objects and features of the present disclosure will be apparent from the following detailed description and claims.

According to one aspect disclosed herein, there is provided a pressure regulating system for a turbo machine comprising a body member having a moving member, an opening and a sealing member. Further a first biasing member for keeping the moving member at a closed position is provided. An actuating line, extended from a main supply line to the pressure regulating system, for actuating on the moving member to counter the bias member by filing pressurized fluid to a preset value into a manifold. An impulse line, extended from the pressure regulating system to the main supply line for supplying the pressurized fluid in at least one chamber of the moving member to lift the moving member to an open position, leads to opening of the sealing member to drain the manifold through the opening.

In another aspect the moving member moves from the open position towards the closed position in a normal time period when the pressure in the impulse line is equal to a lubrication pressure in the turbo machine.

In yet another aspect a bypass is installed between the moving member and the manifold for a fast evacuation of the fluid in a time period less than the normal time period.

In yet another aspect the bypass leads to an early closing of the moving member, increase closing tendency of the moving member.

In yet another aspect, the bypass comprises an inlet opening to receive the fluid form the chamber of the moving member, an outlet opening to drain the fluid from the bypass to the manifold. A closing member is actuated by the flow of the fluid and a second biasing member to counter movement of the closing member.

In the pressure regulating system the moving member responds to the pressure requirements, adapting its position as efficiently as possible, to allow the flow of lubricant if the pressure is high in the turbo machine, or close if the pressure is low in the turbo machine.

The present disclosure also refers to a method for regulating pressure in a turbo machine comprising keeping a moving member through a first biasing member at a closed position, actuating on the moving member through an actuating line, the actuating line extended from a main supply line to the pressure regulating system countering the bias member by filing pressurized fluid into a manifold, permitting the pressure of the pressurized fluid to increase to a preset value in the manifold, supplying the pressurized fluid through an impulse line at least one chamber of the moving member, the impulse line extended from the pressure regulating system to the main supply line, lifting the moving member to an open position which leads to opening of the sealing member to drain the manifold through the opening.

In another aspect, moving the moving member from the open position towards the closed position in a normal time period when the pressure in the impulse line is equal to a lubrication pressure in the turbo machine.

In yet another aspect, a bypass is installed between the moving member and the manifold and evacuating the fluid in a time period less than the normal time period.

In yet another aspect, increasing closing tendency of the moving member and closing the moving member earlier than the normal time period.

In yet another aspect, receiving the fluid form the chamber of the moving member through an inlet opening in the bypass, actuating at least one closing member in the bypass by the flow of the fluid, countering movement of the closing member in the bypass through at least a second biasing member, draining the fluid from the bypass to the manifold through an outlet opening.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will be better understood with reference to the following detailed description and claims taken in conjunction with the accompanying drawings, wherein like elements are identified with like symbols, and in which:

DETAILED DESCRIPTION

Figure 1:
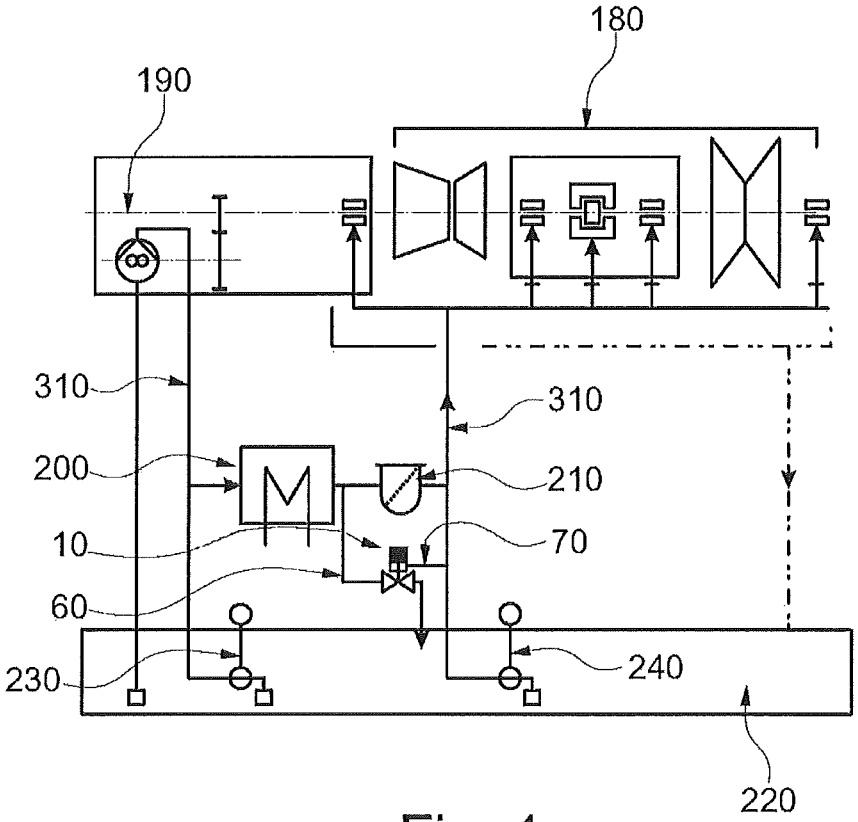
FIG. 1 is a schematic representation of the an arrangement of pressure regulating system with an nuclear steam turbine in accordance with an exemplary embodiment of the present disclosure.
Figure 2:
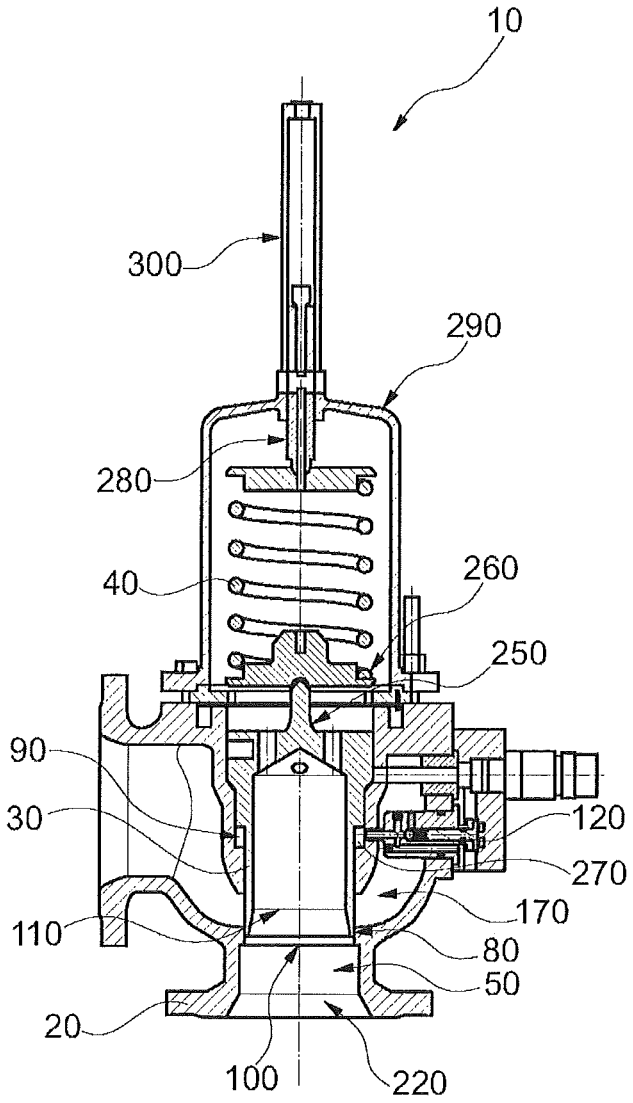
FIG. 2 is a cross section view of a pressure regulating system in accordance with the present disclosure.

FIG. 1. shows schematically a pressure regulating system 10 which is in arrangement with a turbo machine for example a nuclear steam turbine 180. A main lubricant oil pump 190 supply fluid for example lubricant oil to the nuclear steam turbine 180 passes through a cooler 200 and via filter 210 through a main supply line 310. The pressure regulating system 10 is connected to the main supply line 310 through an actuating line 60. Based on requirement of the fluid for example lubricant oil in the nuclear steam turbine 180, excessive fluid can be diverted through the actuating line 60 to the pressure regulating system 10 and from there to oil tank 220. Further in oil tank 220 an auxiliary lubricant oil pump 230 is provided to supplement the supply of the lubricant oil to the nuclear steam turbine 180. An emergency lubricant oil pump 240 has also been provided to supply the lubricant oil to the nuclear steam turbine 180 in case when regular supply is not working As shown in FIG. 2, the pressure regulating system 10 is having a body member 20 for example a casing. The body member 20 having a moving member 30 for example a piston which operates between a closed position 100 and an open position 110. At the closed position 100 the moving member 30 rest on an opening 50 which is attached to an oil tank 220. The opening 50 divert the fluid to the oil tank 220 when the moving member 30 does not rest on the opening 50. The moving member 30 having its head 250 pressing against plate 260 at the open position 110. The plate 260 supports a first biasing member 40 for example a spring. The first biasing member is having a spring compression adjustable by the adjusting screw 280 and spring top 290. A nut 300 has been provided to avoid leakage along the adjusting screw 280. A preset value of force is fixed in the pressure regulating system 10. The first biasing member 40 keeps the moving member 30 at the closed position 100 by applying a first force which is applied through plate 260 onto the head 250 of the moving member 30. The actuating line 60 is actuating on the moving member 30 to counter the first bias member 40 by filing a pressurized fluid for example lubricant oil to a preset value into a manifold 170. The moving member 30 is lifted to the open position 110 by supplying the pressurized fluid in chambers 90, 270 of the moving member 30 through an impulse line 70. The pressurized fluid when filed in the chambers 90, 270 of the moving member 30 creates a second force in the impulse line 70. When the second force in the impulse line 70 is higher than the preset value of the force, keeps the moving member 30 in the open position 110. The pressurized fluid when exceeds the preset value of the fluid in the manifold 170 leads to opening of a sealing member 80 to drain the manifold 170 through the opening 50 to the oil tank 220 when the moving member 30 is at the open position 110. Higher is the pressure in the actuating line 60, more flow will be evacuated by the pressure regulating system 10.

In case when the second force in the impulse line 70 is less than the preset value of the force which is fixed in the pressure regulating system 10, the first biasing member 40 will come down to push the plate 260 onto the head 250 of the moving member 30 to push it towards the closed position 100. The moving member 30 start moving from the open position 110 towards the closed position 100 in a normal time period when the pressure in the impulse line 70 is equal to a required lubrication pressure in the nuclear steam turbine. While closing, the fluid is evacuated. The impulse line 70 extends from the pressure regulating system 10 to the main supply line 310.

The movement of the pressure regulating system 10 is slow due to the hydraulic restrictions of the impulse line 70. For nuclear power plant, the lubricant oil pumps are large and produce large pressure variations when switched on or switched off.

In order to increase the closing tendency of the pressure regulating system 10, a bypass 120 is installed between the moving member 30 and the manifold 170 for a fast evacuation of the fluid in a time period less than the normal time period. The bypass 120 allows faster evacuation of the volume of fluid to the manifold 170 if the difference of pressure between the impulse line 70 and the manifold 170 is higher than a pre-set value. The bypass 120 leads to an early closing of the moving member 30, increase closing tendency of the moving member 30. On the other hand the opening motion of the moving member 30 is unchanged. No fluid is evacuated through impulse line 70.

Figure 3:
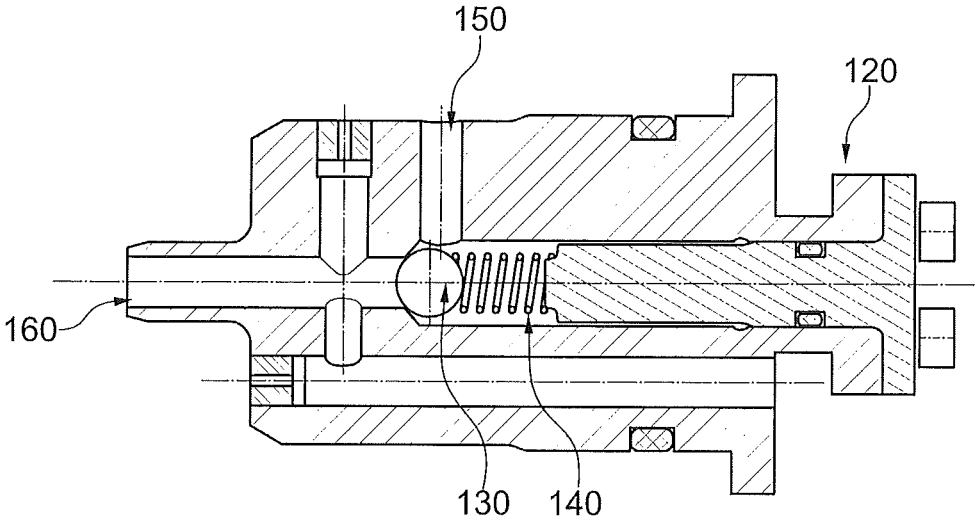
FIG. 3 is a cross section view of a bypass in accordance with the present disclosure.

FIG. 3 is a cross section view of the bypass 120 having an inlet opening 160 to receive the fluid form the chamber 90 of the moving member 30. A closing member 130 for example a ball is actuated by the flow of the fluid through the inlet opening 160. A second biasing member 140 for example a spring counters movement of the closing member 130. The higher pressure of the fluid displace the closing member 130 which in turn moves the second biasing member 140 so that the fluid is drained out from the bypass 120 to the manifold 170 through an outlet opening 150. In absence of fluid supply from the inlet opening 160, the closing member 130 moves back to its original position where it has been kept by the second biasing member 140. The bypass 120 does not allow the reverse flow.

In a method for regulating pressure in a turbo machine for example a nuclear steam turbine 180 keeping a moving member 30 for example a piston through a first biasing member 40 at a closed position. The moving member 30 is actuated on through an actuating line 60 countering the bias member 40 by filing pressurized fluid into a manifold 170. The pressure of the pressurized fluid is permitting to increase to a preset value in the manifold 170, lifting the moving member 30 to an open position 110 which leads to opening of the sealing member 80 to drain the manifold 170 through the opening 50. An impulse line 70 is supplying the pressurized fluid through in chambers 90, 270 of the moving member 30.

The moving member 30 is moving from the open position 110 towards the closed position 100 in a normal time period when the pressure in the impulse line 70 is more than the manifold 170. In order to increase the closing tendency of the pressure regulating system 10, a bypass 120 is installed between the moving member 30 and the manifold 170 which evacuate the fluid in a time period less than the normal time period. Particularly closing tendency of the moving member 30 is increased through the bypass 120 and the moving member 30 is closed earlier than the normal time period. The bypass 120 is receiving the fluid form the chambers 90, 270 of the moving member 30 through an inlet opening 160. A closing member 130 in is actuating by the flow of the fluid. The movement of the closing member 130 is countered through a second biasing member 140. Further the fluid from the bypass 120 to the manifold 170 is drained through an outlet opening 150.

The foregoing descriptions of specific embodiments of the present disclosure have been presented for purposes of illustration and description. They are not intended to be exhaustive or to limit the present disclosure to the precise forms disclosed. Many modifications and variations are possible in light of the above examples. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest, or render expedient, but such are intended to cover the application or implementation without departing from the spirit or scope of the claims of the present disclosure.

The invention claimed is:

1. A pressure regulating system for a turbo machine, the system comprising a body member, the body member comprising a moving member and an opening;

a first biasing member to bias the moving member in a closed position to seal the opening;

an actuating line, extending from a main supply line to the pressure regulating system, the actuating line configured to provide pressurized fluid to a manifold to actuate the moving member to counter the first biasing member;

an impulse line, extending from the pressure regulating system to the main supply line, the impulse line configured to supply the pressurized fluid to at least a chamber of the moving member to lift the moving member to an open position and drain the manifold through the opening; and a bypass, installed between the moving member and the manifold, and wherein the bypass comprises:

an inlet opening to receive the fluid from the chamber of the moving member;

at least one closing member actuated by the flow of the fluid;

at least a second biasing member to counter movement of the closing member; and an outlet opening to drain the fluid from the bypass to the manifold.

2. A method for regulating pressure in a turbo machine, the method comprising:

keeping a moving member in a closed position via a first biasing member;

actuating the moving member, via an actuating line, the actuating line extending from a main supply line to a pressure regulating system;

providing a pressurized fluid into a manifold to a preset value to counter the first biasing member;

supplying the pressurized fluid via an impulse line, to at least one chamber of the moving member, the impulse line extending from the pressure regulating system to the main supply line, lifting the moving member to an open position to drain the manifold through an opening to an oil tank; and providing a bypass between the moving member and the manifold, the bypass configured to:

receive the fluid from the chamber of the moving member through an inlet opening, actuate at least one closing member by the flow of the fluid;

counter movement of the closing member with at least a second biasing member;

drain the fluid from the bypass to the manifold through an outlet opening.

* * * * *